US005848906A

United States Patent [19]

Glusker et al.

[11] Patent Number: 5,848,906

[45] Date of Patent: Dec. 15, 1998

[54] LOADING AND PLACEMENT DEVICE FOR CONNECTING CIRCUIT BOARDS

[75] Inventors: Mark J. Glusker, San Mateo; David J. Lima, Los Altos, both of Calif.

[73] Assignee: Silicon Graphics, Inc., Mountain View, Calif.

[21] Appl. No.: 796,302

[22] Filed: Feb. 7, 1997

[51] Int. Cl.[6] ..... H01R 13/62

[52] U.S. Cl. ..... 439/157; 361/756; 439/64

[58] Field of Search ..... 439/64, 377, 327, 439/372, 159, 157, 928.1; 361/748, 752, 756, 759, 784–790, 796

[56] References Cited

U.S. PATENT DOCUMENTS 3,853,379 12/1974 Goodman et al. ..... 439/328

*Primary Examiner*—Neil Abrams
*Assistant Examiner*—Katrina Davis
*Attorney, Agent, or Firm*—Wagner,Murabito & Hao

[57] ABSTRACT

A loading and placement device for connecting circuit boards using a flex circuit and a compression connector is disclosed. A mounting mechanism holds one or more circuit boards and a flex circuit and a compression connector couple the circuit boards to a circuit board having a backplate hook and rail housings mounted onto it. The rail housings engage the frame of the mounting mechanism for easy alignment and secure attachment. A plate of the mounting mechanism slides so to engage and rotate a cam handle. The movement of the cam handle compresses the connector against the surface to which the backplate hook is mounted, thus achieving a positive connection which locks the compression connector into a position of uniform compression. The circuit boards may be disengaged by sliding the plate of the mounting mechanism so as to rotate the cams into the unlocked position and pulling the mounting mechanism out of the rail housings.

8 Claims, 7 Drawing Sheets

LOADING AND PLACEMENT DEVICE FOR CONNECTING CIRCUIT BOARDS

TECHNICAL FIELD

The present claimed invention relates to the field of electrical connectors. More specifically, the present claimed invention relates to an improved loading and placement device for a compression connector.

BACKGROUND ART

Prior art connection mechanisms for physically and electrically connecting one circuit board to another typically involve the use of standard card edge connectors or pin-in-socket connectors which simply slide into connector receptacles located on the second circuit board. Typically, one circuit board will have a connector attached thereto, wherein the connector includes a row of contact pins aligned in a plane parallel to the surface of the board. The connector is mated to a connector receptacle on a second circuit board. The connector receptacle typically includes a slot adapted to receive the contact pins of the connector. The two boards are typically held together by the tight tolerance between the housing of the connector and the structure of the slot of the connector receptacle.

However, as signal processing speeds increase, these prior art connection mechanisms are not practical for use due to inherent signal delay. Signal delay results from the impedance mismatch between the circuit board and the connector, resulting in overlapping or lost electrical signals. Thus, a need exists for a connecting mechanism which provides impedance matching so as to eliminate the problems associated with signal delay. In an attempt to meet this need, recently designed prior art connection mechanisms include mechanisms which use a compression connector incorporating a flex circuit. However, although prior art connection mechanisms which use a compression connector incorporating a flex circuit solve the problem of signal delay, the connection mechanism often does not make adequate contact with the circuit board to which the connection mechanism is coupled. In addition, the contact varies from installation to installation.

Prior art methods for using a compression connector to connect a mother board to a daughter board simply involves pressing the male end of the compression connector against the motherboard. The daughter board is then secured to the mother board using mounting screws which secure the compression connector to the motherboard. In order for the mounting screws to be accessible, the screws must extend to the back of the daughter board. Thus, the mounting screws are quite long. The mounting screws take up room that could be used for attaching other components to the daughter board and they act as antennas, thereby creating signal interference. Furthermore, the installation of the mounting screws is difficult and time consuming. The resulting contact between the pads of the flex circuit and the pads on the motherboard varies from installation to installation, sometimes resulting in incomplete contact for one or more contact pads.

In some recent prior art connection mechanisms which include a compression connector with a flex circuit, the long screws are mounted on the edges of the daughter board so as to minimize physical interference with the circuit board surface. This solves the problem of screws blocking regions of the daughter board that could be used for mounting electrical devices to the daughter board. However, this mounting structure still requires the laborious screwing-in of each of the long screws. In addition, the problems associated with incomplete and insufficient contact and problems arising from the screws acting as antennas are not solved.

The compression connector solves many of the problems associated with prior art connection mechanisms. However, in a crowded computer housing, it is often difficult to align the compression connector and it is difficult to attach the compression connector to the motherboard so as to compress the compression connector. Thus, it is difficult to lock the two circuit boards together. The process is particularly cumbersome for computer users who are accustomed to prior art designs which simply involve pressing the two boards together so as to mate card edge connectors to slotted connector receptacles.

Due to the higher cost per contact of flex based compression connectors, conventional pin-in-socket or card edge connectors are often used in conjunction with compression connectors on the same circuit board. Thus, when conventional pin-in-socket and card edge connectors are used in conjunction with a compression connector, the demands of both the conventional pin-in-socket and the card edge connectors must be met. Conventional connectors typically have a significant force to insert and extract the connectors, which must be applied over the insertion distance of the connector. Once fully inserted, no additional force is needed. Compression connectors, by contrast, typically have zero insertion force. However, force must be applied to the compression connector after insertion in order to maintain connectivity. Also, due to the nature of a compression connection, there can be no derivation between the position of the compression connector on the daughter-board and the mating surface of the mother board. Thus, when card edge connector and pin-in-socket connectors are used in conjunction with a compression connector, the attachment mechanism must allow the user to insert the circuit board(s) into the chassis, apply sufficient force to mate the card edge connectors, ensure that the compression connector is properly in contact with the motherboard and finally apply sufficient force to the compression connector to maintain connectivity.

What is needed is a method and apparatus for achieving simple and uniform loading and placement for connecting circuit boards using a connector mechanism including a compression connector incorporating a flex circuit. More specifically, a loading and placement mechanism is required which will align the compression connector with the motherboard and which will positively secure the daughter board to the motherboard. In addition, a loading and placement mechanism which will allow for conventional pin-in-socket and card edge connectors to be used in conjunction with a compression connector, and which will meet the demands of both the conventional pin-in-socket and the card edge connectors is needed.

DISCLOSURE OF THE INVENTION

The present invention meets the above need with a connection mechanism which will align a compression connector and which will rotate a cam handle located on the compression connector so as to positively lock the daughter board to the motherboard. The above achievement has been accomplished by using a connection mechanism including rail housings which align the compression connector to a backplate hook and a slider coupled to a cam plate which rotates the cam handle so as to positively engage the compression connector.

A loading and placement device for a connection mechanism which includes a compression connector using a flex circuit and cams is disclosed. The flex circuit based compression connector and the mechanism to apply force to it are attached to one of the circuit boards. Cams located on the compression connector mechanism draw the connection mechanism towards a backplate hook attached to the other circuit board so as to positively lock the circuit boards together. This connection mechanism solves many of the problems associated with prior art connection mechanisms. However, in order to attach the connection mechanism, the circuit boards must be carefully aligned and the cam handle must be rotated. In a crowded computer housing, it is often difficult to align the compression connector with the backplate hook and it is difficult to reach the cam handle. Therefore, it is difficult to lock the two circuit boards together.

In one embodiment of the present invention two rail housings are attached to the chassis containing the motherboard. The motherboard contains a backplate hook having two posts. A mounting mechanism including a slider and a cam plate having a slot formed in it are coupled to the second circuit board which may be referred to as the daughter board. A connection mechanism including a flex circuit and a compression connector having two cams and a cam handle is connected to the daughter board. The circuit boards are connected by inserting the mounting mechanism into the rail housings attached to the chassis. Once the mounting mechanism is placed against the motherboard, pressing the slider towards the motherboard presses the surface of the slot in the cam plate against the cam handle such that the cams are rotated. The rotation of the cams engages the posts of the backplate hook, thereby drawing the daughter board to the motherboard until the locked position of the cams is achieved. Thus, easy alignment and full engagement and locking of the compression connector is achieved. Since the use of rail housings automatically aligns the mounting mechanism, and since the engagement of the cam handle simply requires the pressing of the slider towards the motherboard, the loading and placement device allows for easy alignment and engagement even in those situations where the daughter board is being mounted in close proximity to other circuit boards and devices.

The two circuit boards may be easily disengaged by pulling the slider away from the motherboard such that the cams are rotated out of the locked position. The mounting mechanism may then be pulled out of the mounting rails. Thus, no long screws need to be manipulated and no screwdriver or other tool is required to disengage the two circuit boards.

The mounting mechanism may accommodate multiple daughter boards. Therefore, multiple daughter boards may be simultaneously mounted to and detached from the motherboard. The simultaneous mounting of multiple daughter boards avoids the need to align multiple boards and to screw in screws attached to each board, thus producing a simpler and more efficient installation.

The mounting mechanism also contains extractor cams which provide mechanical advantage for insertion and extraction of multiple conventional pin-in-socket connectors and card edge connectors. These cams also serve as a means of synchronizing the operation of the compression connector mechanism on the daughter board. This is important since the daughter board must be nearly completely seated before the compression connector mechanism can be actuated.

The present invention also mates conventional card edge connectors and pin-in-socket connectors. Conventional pin-in socket connectors and card edge connectors typically require a significant force to insert and extract the connectors, which must be applied over the insertion distance of the connector. Once fully inserted, no additional force is needed. Compression connectors, by contrast, typically have zero insertion force. However, force must be applied to the compression connector after insertion in order to maintain connectivity. Also, due to the nature of a compression connection, there can be no derivation between the position of the compression connector on the daughterboard and the mating surface of the mother board. The present invention allows for the insertion of the circuit board(s) into the chassis, applies sufficient force to mate any card edge connectors and pin-in-socket connectors, ensures that the compression connector is properly in contact with the motherboard and applies sufficient force to the compression connector to maintain connectivity.

These and other objects and advantages of the present invention will no doubt become obvious to those of ordinary skill in the art after having read the following detailed description of the preferred embodiments which are illustrated in the various drawing figures.

BRIEF DESCRIPTION OF THE DRAWINGS

The accompanying drawings, which are incorporated in and form a part of this specification, illustrate embodiments of the invention and, together with the description, serve to explain the principles of the invention.

BEST MODE FOR CARRYING OUT THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 1:
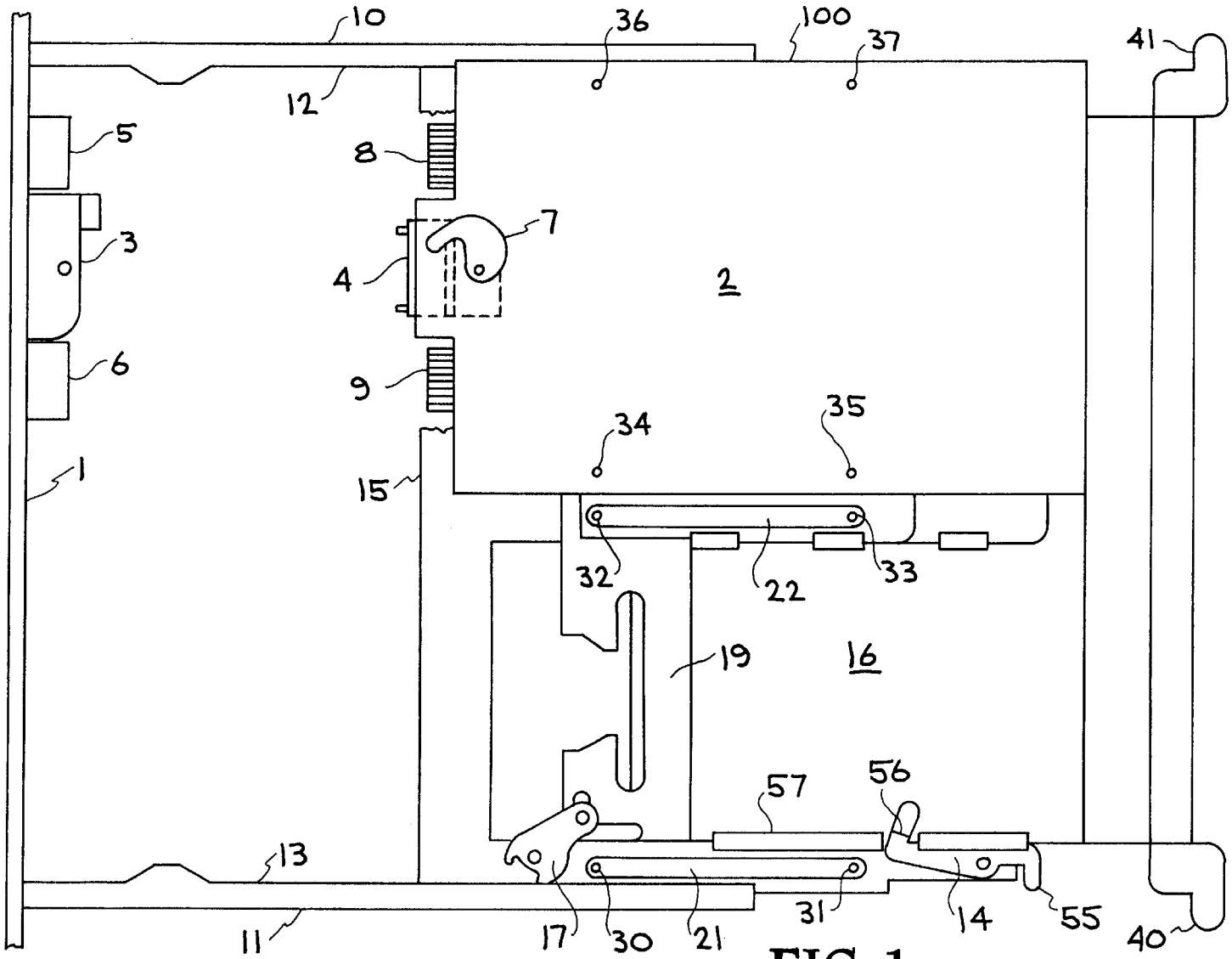
FIG. 1 is a side view illustrating a mounting mechanism which is in the disengaged position opposite a chassis attached to a circuit board in accordance with the present invention.

With reference now to FIG. 1, daughter board 2 is shown to be attached to mounting mechanism 100 and is directly opposite motherboard 1. Backplate hook 3 is secured to motherboard 1. Connector receptacle 5 and connector receptacle 6 are also attached to motherboard 1. The chassis attaches to top rail housing 10 which houses rail 12 and bottom rail housing 11 which houses rail 13. Compression connector 4 is securely attached to daughter board 2. Upon insertion of mounting mechanism 100 such that the top edge of frame 15 is engaged with rail 12 and the bottom edge of frame 15 is engaged with rail 13, compression connector 4 mates with backplate hook 3. Standard card-edge connector 8 is attached to daughter board 2 and mates with connector receptacle 5 attached to motherboard 1. Similarly, standard card-edge connector 9 is attached to daughter board 2 and mates with connector receptacle 6 attached to motherboard 1.

Continuing with FIG. 1, daughter board 2 is attached to the frame 15 by screw 34 and screw 35 which screw into float plate 23 (not shown) and screw 36 and screw 37 which screw into float plate 24 (not shown). Float plate 21 is attached to frame 15 by screw 30 and screw 31. Float plate 22 is attached by screw 32 and screw 33. Cam plate 19 (and cam plate 18 which lies directly behind cam plate 19 and which is not shown) are attached to frame 15 and slider 16 such that cam plate 18–19 and slider 16 may slide within frame 15. Handle 40 and handle 41 attach to slider 16 for easy manipulation of the loading and placement device. Extractor cam 17 is coupled to cam plate 18 and cam plate 19. Interlock 14 is coupled to slider 16 and includes interlock tip 55 and interlock projection 56. Interlock projection rests against lock bar 57 which is attached to frame 15.

Figure 2:
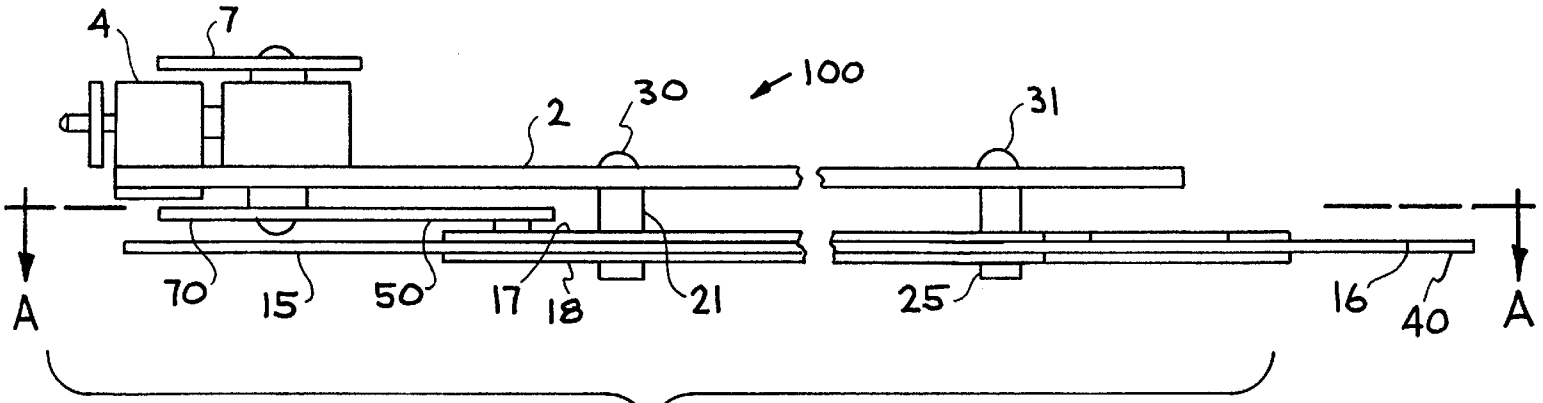
FIG. 2 is a bottom view illustrating a mounting mechanism which is in the disengaged position in accordance with the present invention.

FIG. 2 shows mounting mechanism 100 in the retracted position to include compression connector 4. Compression connector 4 includes cam 7 and cam 70 and cam handle 50. It can be seen that, in the retracted position, cam handle 50 protrudes from the side surface of the connector. Compression connector 4 is securely attached to daughter board 2 and to frame 15. Daughter board 2 is coupled to frame 15 by screw 30 and screw 31 which attach to float plate 21 and to float plate 25 so as to allow daughter board 2 and slider 16 to move within a limited range relative to frame 15. Handle 40 which is attached to slider 16 allows for easy movement of slider 16.

Figure 3:
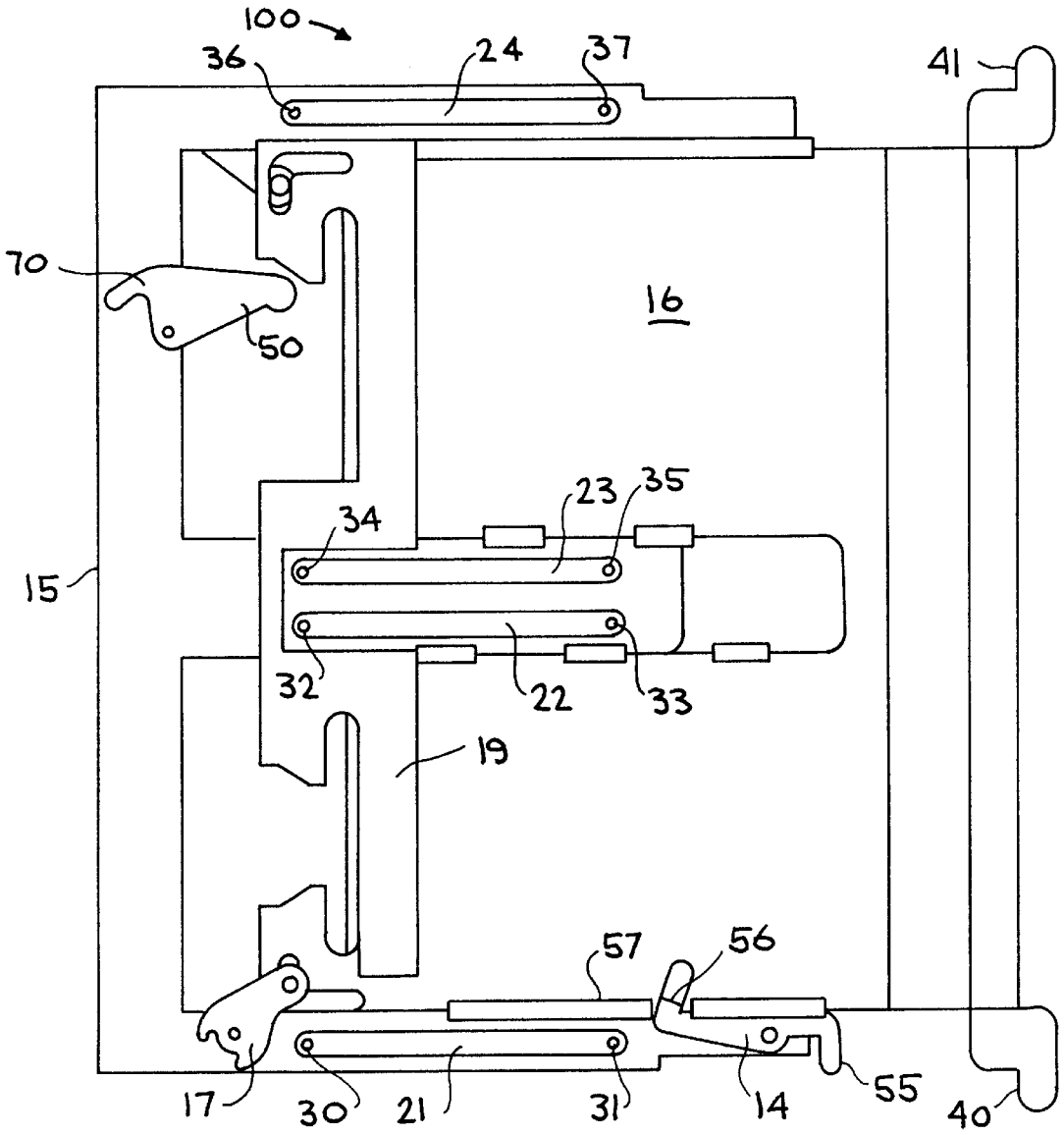
FIG. 3 is a cross section view along axis A—A of FIG. 2 showing a mounting mechanism which is in the disengaged position in accordance with the present invention.

FIG. 3 shows a cross section along axis A—A of FIG. 2 of mounting mechanism 100 in the disengaged position. Slider 16 lies between cam plate 19 and cam plate 18 (not shown) and is attached to frame 15 by float plates 21–24 and float plates 25–28 (not shown) which lie directly behind float plates 25–28. Screws 34–35 which screw into float plate 23 and screws 36–37 which screw into float plate 24 and screws 30–31 which screw into float plate 21 and screws 32–33 which screw into float plate 22 attach float plates 21–24 to float plates 25–28 which are not shown so as to allow the slider 16 and the cam plate 19 and cam plate 18 (not shown) to move within a limited range relative to frame 15 within rails 12–13. Handle 40 and handle 41 attach to slider 16 for easy manipulation of the loading and placement device. Extractor cam 17 is coupled to cam plate 19. Interlock 14 is coupled to slider 16 such that interlock projection 56 holds the interlock 14 into a locked position so as to lock the slider 16 into the disengaged position. When the interlock 14 is locked in the disengaged position, interlock tip 55 projects from the side of rail 13(not shown).

Figure 4:
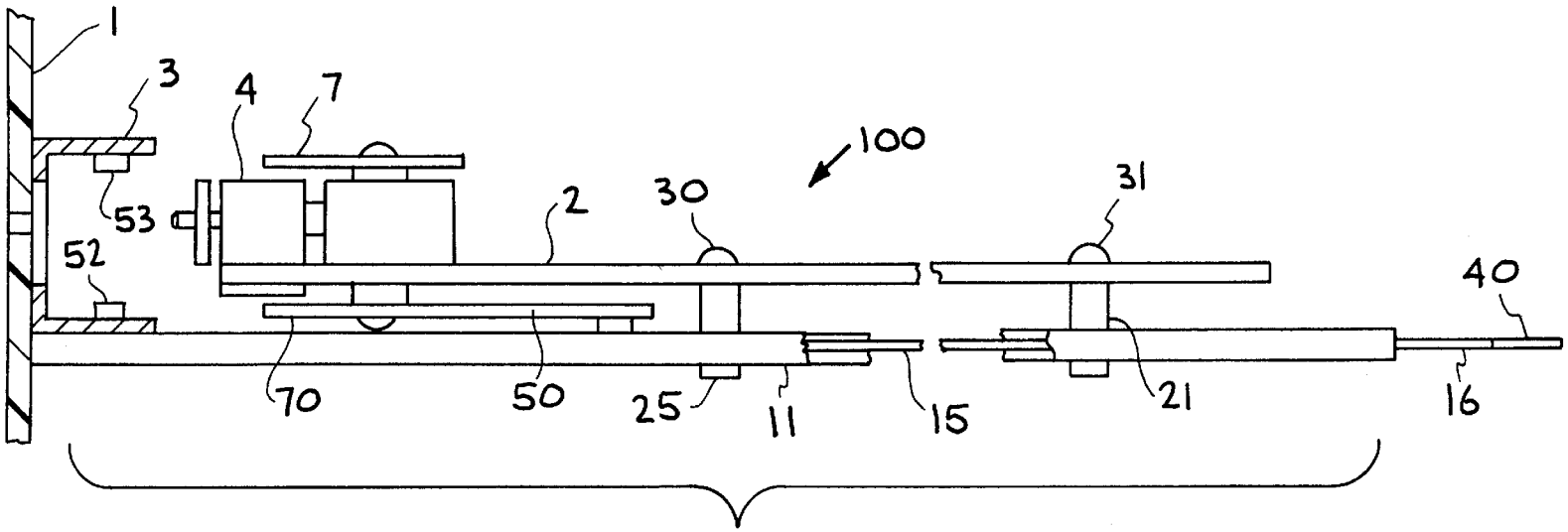
FIG. 4 is a bottom view illustrating a motherboard onto which rail housings are attached and a mounting mechanism which is in the disengaged position in accordance with the present invention.

FIG. 4 illustrates a bottom view of mounting mechanism 100 upon insertion into rail 12 of top rail housing 10 and rail 13 of bottom rail housing 11 such that the mounting mechanism approaches motherboard 1. Compression connector 4 fits into backplate hook 3 such that cam 7 and cam 70 may engage with peg 52 and peg 53 located on backplate hook 3. Standard card-edge connector 9 is attached to daughter board 2 and aligns with connector receptacle 6 attached to motherboard 1.

Figure 5:
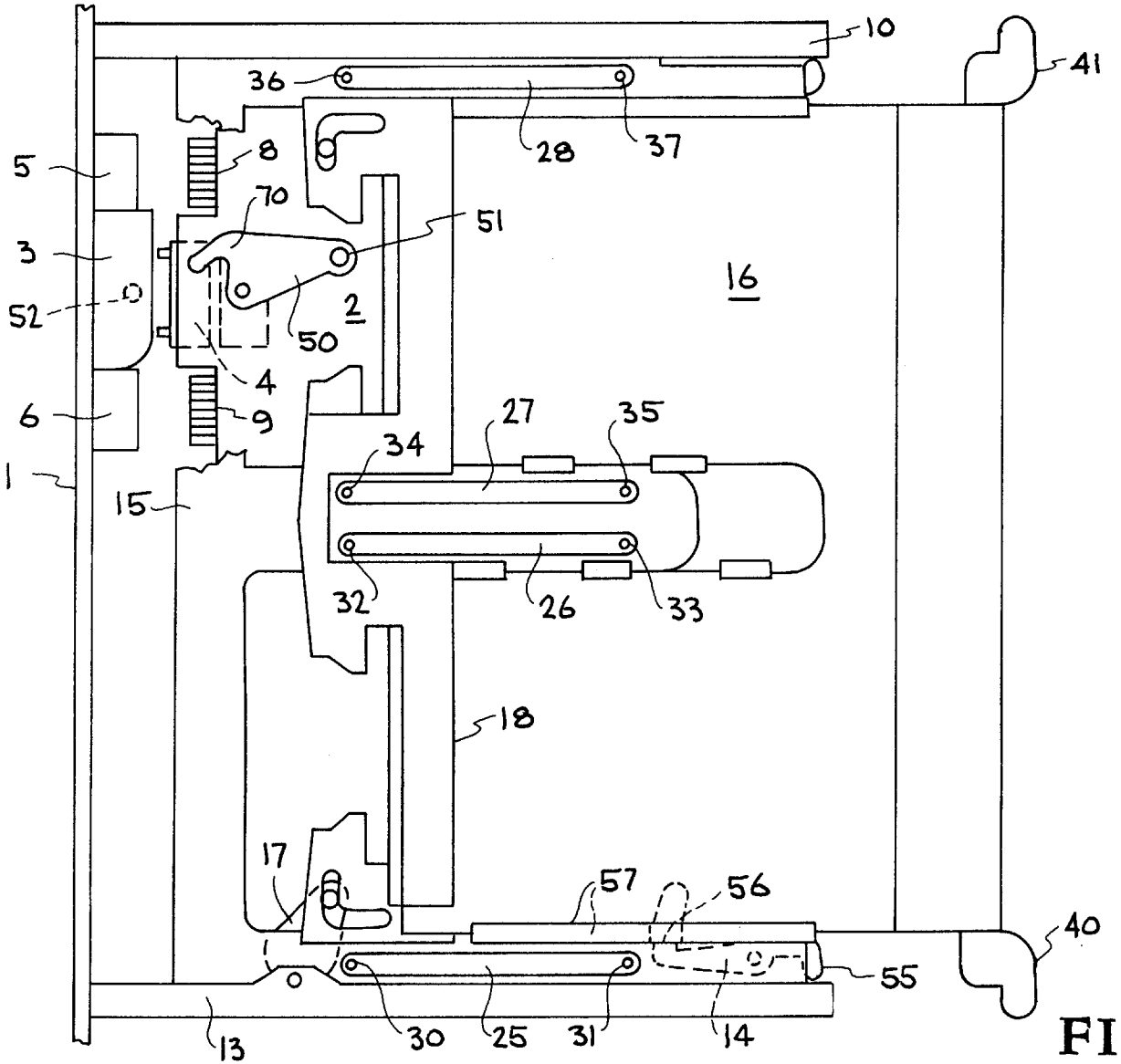
FIG. 5 is a rear side view showing a motherboard onto which rail housings are attached and a mounting mechanism which is in the disengaged position in accordance with the present invention.

FIG. 5 shows a side view of mounting mechanism 100 upon insertion into top rail housing 10 and bottom rail housing 11 such that the mounting mechanism approaches motherboard 1. Mounting mechanism 100 is inserted into top rail housing 10 such that the upper edge of frame 15 engages a slot in rail 12 so as to secure mounting mechanism 100 into top rail housing 10. Similarly, the bottom edge of frame 15 slides into a slot in rail 13 in bottom rail housing 11 so as to secure mounting mechanism 100 into bottom rail housing 11. Upon the insertion of mounting mechanism 100, bottom rail housing 11 engages the interlock tip 55 so as to move the interlock 14 into the unlocked position. In the unlocked position, the interlock projection 56 no longer engages the lock bar 57 such that the slider 16 is free to move. Compression connector 4 enters into backplate hook 3 such that post 52 is in close proximity to cam 70 and cam 7 is in close proximity to post 53. Extractor cam 17 is disengaged from rail 13. A second extractor cam (not shown) engages with rail 12.

Figure 6:
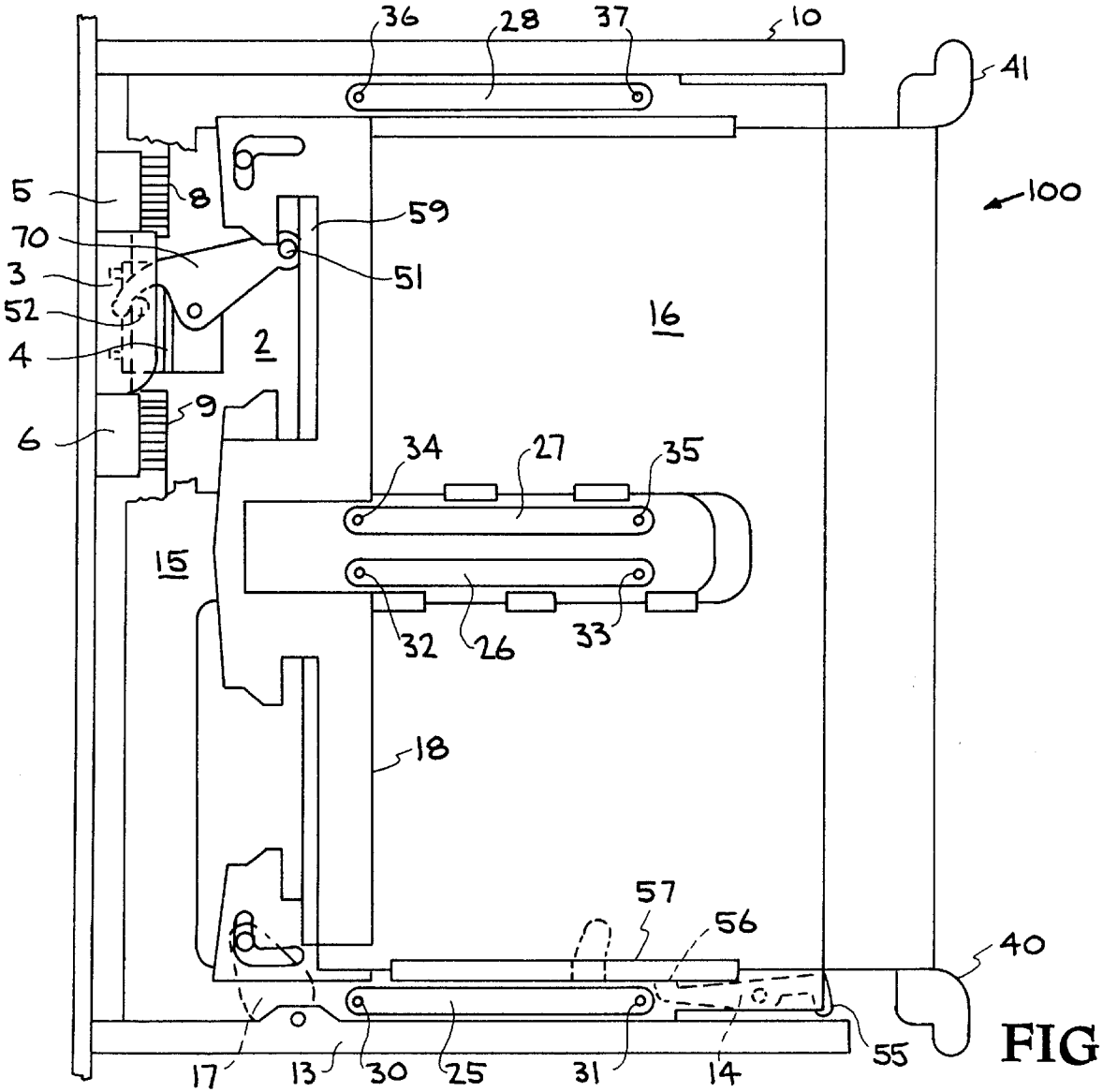
FIG. 6 shows the structure of FIG. 5 after partial insertion of the slider in accordance with the present invention.

FIG. 6 shows the structure of FIG. 5 after slider 16 is moved towards the motherboard 1 such that the surface of slot 59 engages cam post 51. Upon pressing slider 16 towards the motherboard 1, slider 16 and cam plate 19 and cam plate 18 (not shown) move within rail 11 and rail 12 until the surface of slot 59 engages cam post 51. Extractor cam 17 engages a post within rail 13 which causes extractor cam 17 to rotate. Cam 70 is close to post 52.

Figure 7:
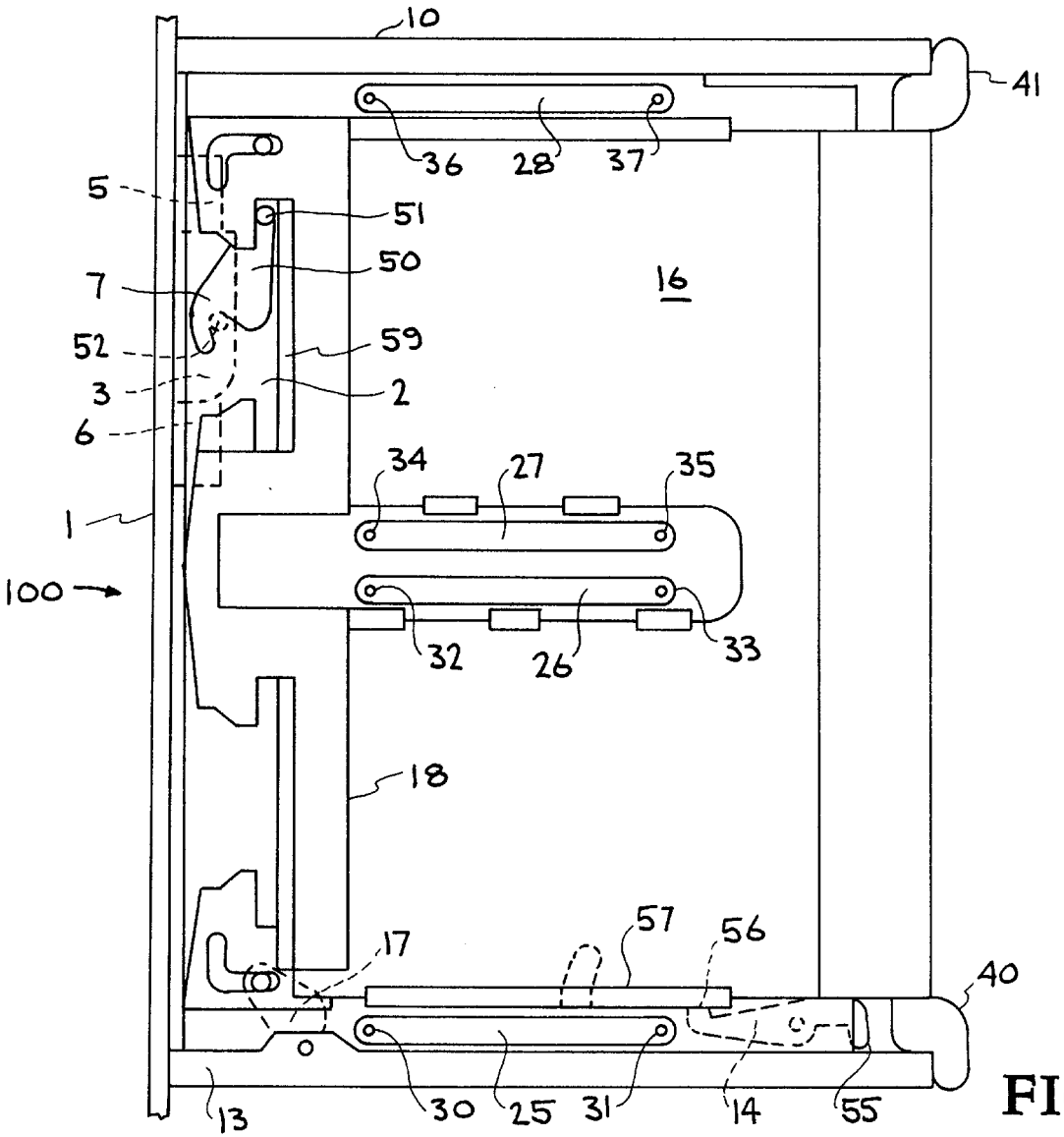
FIG. 7 shows the structure of FIG. 5 after full insertion of the slider in accordance with the present invention.

FIG. 7 shows the structure of FIG. 6 after the slider is inserted into the fully engaged position. The insertion of slider 16 causes the surface of cam plate 19 at slot 59 to press against cam post 51 so as to rotate cam 70 into the fully engaged position. The rotation of cam 70 engages posts 52 so as to pull the mounting mechanism 100 towards the motherboard 1. The movement of the mounting mechanism 100 presses the compression connector 4 (not shown) against the motherboard 1 so as to compress the compression connector 4. The insertion also rotates extractor cam 17. Standard card edge connector 8 mates with connector receptacle 5.

Figure 8:
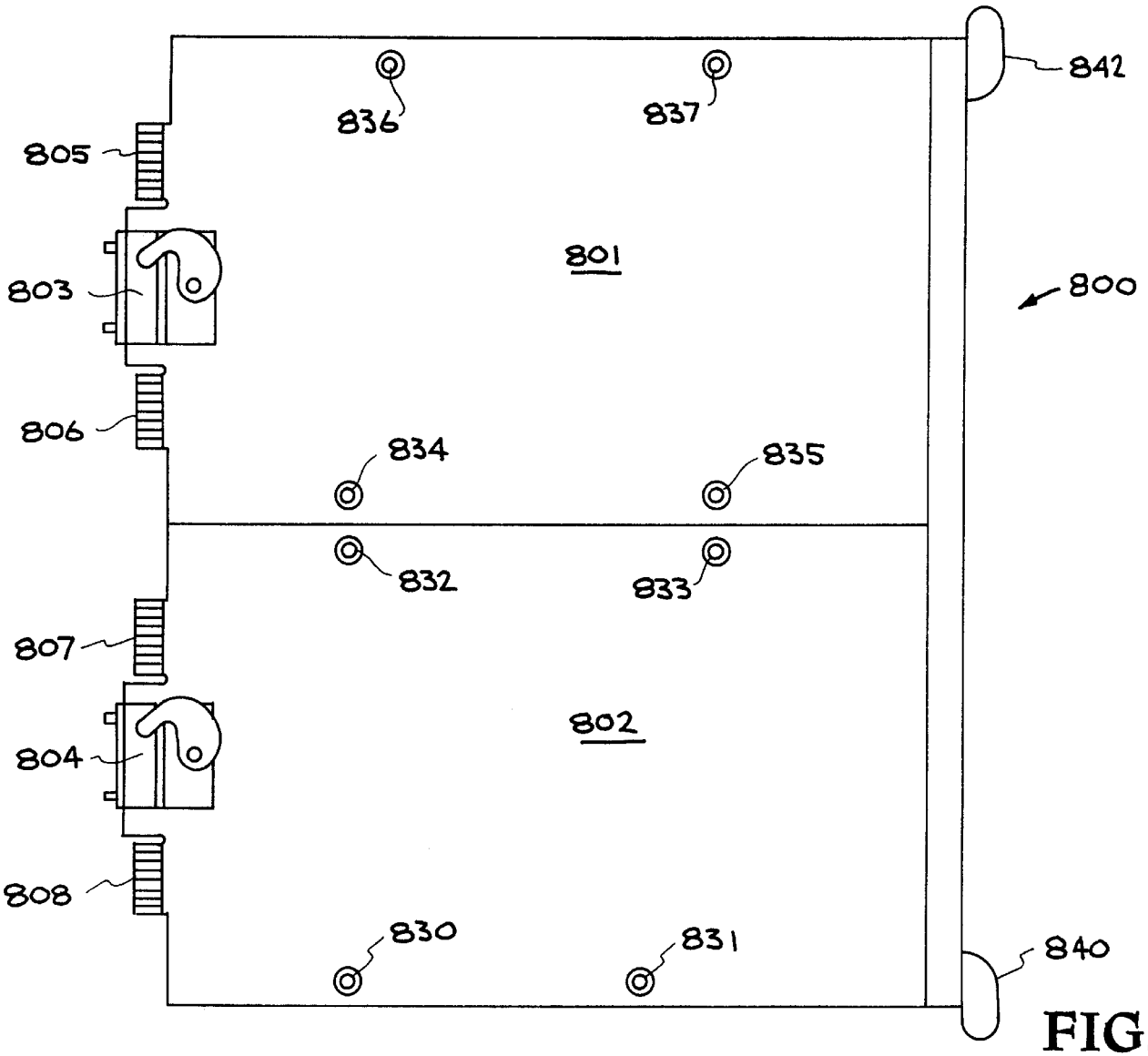
FIG. 8 is a side view showing a mounting mechanism which is in the disengaged position which includes two circuit boards in accordance with the present invention.

FIG. 8 shows a loading and placement device having two circuit boards loaded onto it. Circuit board 801 and circuit board 802 are both attached to the mounting mechanism 800. Compression connector 803 is attached to circuit board 801 by screws 834–837. Compression connector 804 is attached to circuit board 802 by screws 830–833. Standard card edge connector 805 and standard card edge connector 806 are coupled to circuit board 801. Similarly standard card edge connector 807 and standard card edge connector 808 are attached to circuit board 802. Handle 840 and handle 842 allow for easy manipulation of the mounting mechanism 800.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

We claim:

1. A loading and placement mechanism for coupling a first circuit board to a second circuit board comprising:

a frame;

a top rail housing coupled to said first circuit board;

a bottom rail housing disposed below said top rail housing and coupled to said first circuit board;

a hook coupled to said first circuit board said hook including a first post and a second post;

a compression connector coupled to said second circuit board, said compression connector including a first cam and a second cam coupled thereto such that said first cam and said second cam rotate, said first cam having a cam post extending therefrom;

a cam plate having a slot disposed therein, said cam plate coupled to said frame;

a plate coupled to said cam plate and coupled to said frame such that said plate and said cam plate move within said frame such that, upon the insertion of said frame between said bottom rail housing and said top rail housing, said plate is adapted to be pushed inwardly such that said slot in said cam plate engages said cam post so as to rotate said first cam and said second cam such that said first cam engages said first post and said second cam engages said second post, thereby compressing said compression connector against said first circuit board such that said first circuit board is electrically coupled to said second circuit board.

2. The loading and placement mechanism for coupling a first circuit board to a second circuit board of claim 1 wherein said cam plate comprises a first cam plate, said loading and placement mechanism further comprising:

a second cam plate, said first cam plate and said second cam plate attached to said plate, said first cam plate disposed over said plate and said second cam plate disposed below said plate such that the movement of said plate moves said first cam plate and said second cam plate.

3. The loading and placement mechanism for coupling a first circuit board to a second circuit board of claim 1 wherein said plate has an open position and an engaged position, and wherein said plate may be moved from said open position to said engaged position by the movement of said plate within said frame such that, upon the insertion of said frame between said bottom rail housing top rail housing, said slider plate may be moved from said open position to said engaged position.

4. The loading and placement mechanism for coupling a first circuit board to a second circuit board of claim 3 wherein the surfaces of said first cam and said second cam are contoured, said first cam and said second cam adapted to be moved into a locked position such that, upon the insertion of said frame between said bottom rail housing and said top rail housing, said plate may be pushed inwardly such that said slot in said cam plate engages said cam post so as to rotate said first cam and said second cam into said locked position such that said first circuit board is positively locked to said second circuit board.

5. The loading and placement mechanism for coupling a first circuit board to a second circuit board of claim 4 further comprising an extraction cam, said extraction cam coupled to said plate such that, once said first circuit board is connected to said second circuit board, said slider plate may be pulled outwardly such that said extraction cam exerts a force against said frame so as to mechanically assist the movement of said plate.

6. The loading and placement mechanism for coupling a first circuit board to a second circuit board of claim 5 further comprising a plurality of float plates, said float plates coupled to said frame and coupled to said plate and coupled to said cam plate so as to allow said plate and said cam plate to move within a limited range within said frame.

7. The loading and placement mechanism for coupling a first circuit board to a second circuit board of claim 6 further comprising an interlock bar, said interlock bar having a interlock tip end and a locking end, said interlock bar pivotally connected to said plate such that said locking end may lock said slider into said open position such that, upon the insertion of said frame between said bottom rail housing and said top rail housing, said interlock tip end contacts said bottom rail housing so as to pivot said interlock bar such that said locking end no longer locks said plate into said open position such that said plate may be pushed inwardly into said engaged position.

8. A loading and placement device for coupling a first circuit board to a second circuit board comprising:

a top rail housing coupled to said first circuit board, said top rail housing including a first rail;

a bottom rail housing coupled to said first circuit board below said top rail housing, said bottom rail housing including a second rail;

a first post coupled to said first circuit board;

a second post coupled to said first circuit board;

a compression connector coupled to said second circuit board, said compression connector including a first cam and a second cam, said first cam coupled to said second cam such that said first cam and said second cam rotate together, said first cam having a cam post extending therefrom, said compression connector including a flex circuit electrically coupled to said second circuit board;

a frame, said second circuit board coupled to said frame such that said frame may be inserted between said first rail and said second rail so as to align said second circuit board with said first circuit board;

a cam plate disposed within said frame such that said cam plate moves within said frame, said cam plate having a slot disposed therein such that, upon the insertion of said frame between said first rail and said second rail, said slot is disposed proximate said cam post;

a plate coupled to said cam plate and disposed within said frame such that said plate moves within said frame; and wherein, upon the insertion of said frame between said top rail housing and said bottom rail housing, said plate is adapted to be moved towards said circuit board so as to move said cam plate towards said circuit board, the movement of said cam plate rotating said first cam and said second cam so as to engage said first post and said second post, thereby pulling said compression connector against said first circuit board so as to electrically couple said second circuit board to said first circuit board.

* * * * *